US006379197B2

(12) United States Patent
Matsuda et al.

(10) Patent No.: US 6,379,197 B2
(45) Date of Patent: Apr. 30, 2002

(54) TERMINAL CONNECTOR

(75) Inventors: Takeshi Matsuda; Nobuyuki Mano, both of Tokyo (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/780,655

(22) Filed: Feb. 9, 2001

Related U.S. Application Data

(63) Continuation of application No. PCT/JP00/02722, filed on Apr. 26, 2000.

(30) Foreign Application Priority Data

Sep. 10, 1999 (JP) ..... 11-257961

(51) Int. Cl.[7] ..... H01R 4/30; H01R 4/38
(52) U.S. Cl. ..... 439/801
(58) Field of Search ..... 439/801, 811

(56) References Cited

U.S. PATENT DOCUMENTS 4,171,152 A * 10/1979 Geiseler ..... 439/752
4,832,628 A * 5/1989 Huska ..... 439/716
5,171,160 A * 12/1992 Beins et al. ..... 439/329
5,664,971 A 9/1997 Coy ..... 439/812

FOREIGN PATENT DOCUMENTS

JP 09055268 2/1997 ..... 23/68

* cited by examiner

*Primary Examiner*—Tulsidas Patel
*Assistant Examiner*—Brian S. Webb
(74) *Attorney, Agent, or Firm*—Morrison Law Firm

(57) ABSTRACT

An insulative circuit board receives a forged terminal and a simplified terminal plate, inserted through a through hole and guided by insertion slots, to form a complete terminal connector. The terminal plate firmly fixes to the insulative circuit board by locking into integrally formed locking steps. The terminal is retained by the snap-in terminal plate. and preventive elements formed integrally with the circuit board. Preventive elements prevent unexpected disassembly when the terminal and the terminal plate loose threaded engagement and eliminates the need for after-integration processing. A guiding element, integral with the terminal, guides the terminal into threaded engagement with the terminal plate. The guiding element also prevents damage to a terminal plate screw hole and speeds assembly.

4 Claims, 6 Drawing Sheets

TERMINAL CONNECTOR

This application is a continuation of PCT/JP00/02722 filed Apr. 26, 2000.

BACKGROUND OF THE INVENTION

1. Field of the Invention

The present invention relates to a terminal connector for input and output of electric signals, particularly in audio and video equipment systems.

2. Description of the Related Art

Referring to FIG. 4, a conventional terminal connector, shown generally at 100', includes an electrically conductive terminal plate 14 mounted on an insulative circuit board 10. A terminal 15 is secured to insulative circuit board 10 by a screw portion 17 threaded through a screw hole 16 in terminal plate 14. A knob 19', affixed projecting away from insulative circuit board 10 enables screwing and unscrewing screw portion 17 for making electrical connection, as will be explained. Conventional terminal connectors of this type generally have a four-gang or eight-gang configuration.

Circuit board 10 includes four cylindrical portions 11 (two not shown). Cylindrical portions 11 are integrally formed on a first surface of circuit board 10 and surround a part of terminals 15 near the first surface of circuit board 10. Cylindrical portions 11 help avoid lead wire shorts and reduce the chance of electrical contact with a person or an object. Cylindrical portions 11 each have at least one lead wire insertion notch 12 in an outer periphery.

A through hole 13 accommodates adjustable screw portion 17 of terminal 15. Screw portion 17 is centered in cylindrical portion 11. Around through hole 13, a plurality of insertion holes 20 permit insertion of one or more press-in lock pieces 21 and a terminal portion 22 of terminal plate 14 into selected insertion holes 20 to fix terminal plate firmly to insulative circuit board 10. Terminal portions 22 have connective ends formed opposite terminal plate 14 for connecting to a printed circuit board 34.

During assembly, the extremities of terminal portions 22 of terminal plates 14 are inserted into cylindrical portions 11 from above and slipped partially into insertion holes 20. Further insertion of terminal portions 22 requires rotating terminal portion 22 (counter clock wise to the plane of the page) to allow bends 33 to freely pass through cylindrical portions 11 and protrude from a second surface of circuit board 10. As terminal portions 22 protrude through the second surface of the insulative circuit board 10, press-in lock pieces 21, of terminal plates 14, are pressed into the remaining insertion holes 20 for fixture. After assembly, a bottom surface of terminal plate 14 rests directly against a top surface of circuit board 10.

After the integration of terminal plates 14 and terminal portions 22, terminals 15 are threaded into terminal plates 14. Screw portions 17 are screwed into screw holes 16 formed in terminal plate 14. When each screw portion 17 is tightened, a collar 18 of terminal 15 contacts terminal plate 14, and an end portion of screw portion 17 protrudes below the second surface of insulative circuit board 10. After tightening, the end portion of screw portion 17 is mechanically flattened to form a preventive bulged portion 31 and disrupt a continuous helical thread formed on screw portion 17. Preventive bulged portion 31 prevents terminal 15 from disengaging screw hole 16 or from being lost during later adjustment.

Once terminal plates 14 and terminals 15 arc connected to circuit board 10, knobs 19' are loosened sufficiently to allow insertion of at least one lead wire 32 through insertion notches 12. When screw portion 17 of each terminal 15 is tightened toward screw hole 16 in terminal plate 14, a bottom surface of collar 18 and a top surface of terminal plate 14 sandwich lead wire 32 for electrical contact. A banana plug (not shown) may be inserted into a terminal body 59', contained within terminal 15, having a plug insertion opening 26 and a plug connection portion 23, for electrical connection. More than one lead wire may be captured this way, and connected to a connector inserted into plug connection portion 23 and/or terminal portion 22.

Referring additionally to FIGS. 5 and 6, insertion holes 20 permit insertion of one or more press-in lock pieces 21 and terminal portions 22 of terminal plate 14 to firmly fix terminal plate 14 to insulative circuit board 10. In FIG. 5, bulged portions 31 expand beyond an outside diameter of screw portion 17, thus preventing disengagement. In FIG. 6, terminal portions 22 may be of different lengths and each respective bends 33 of different curvature radius.

Conventional terminal connectors create several manufacturing difficulties. First, it is difficult to automate the step of integrating terminal plate 14, with press-in lock pieces and terminal portions 22, into insulative circuit board 10. The extremities of terminal portions 22 require insertion in conformity with the curves on bends 33 from above the cylindrical portion 11. Additionally, printed circuit board 34 may have terminal plates 14 with different length terminal portions 22, depending upon production requirements. This difference in length makes automated assemnbly difficult.

Second, the flattening step forming bulged portions 31, described above, needs to be performed after terminal plates 14 and terminals 15 are installed into insulative circuit board 10. As a result, performing the flattening step, during subassembly of terminal 15, is inconvenient and increases manufacturing time and cost.

Third, during the assembly of conventional terminal connectors 100' in general and during the flattening step of bulged portions 31 specifically, damage can occur to exposed terminal portions 22. As a result, manufacturing waste and costs are increased.

OBJECTS AND SUMMARY OF THE INVENTION

It is an object of the present invention to provide a terminal connector where automated assembly of multiple terminal plates into an insulative circuit board is easy.

It is another object of the present invention to provide a terminal connector which eliminates the need for an after-assembly flattening step while providing means for preventing the terminals from falling off or disconnecting from the terminal plates.

It is another object of the present invention to provide a terminal connector having an improved assembly time and a lower defect rate.

It is another object of the present invention to provide a terminal connector with reduced size and smaller footprint.

An insulative circuit board receives a forged terminal and a simplified terminal plate inserted through a through hole and guided by insertion slots, to form a terminal connector. The terminal plate firmly fixes to the insulative circuit board by locking into integrally formed locking steps. The terminal is retained by the snap-in terminal plate and preventive means formed integrally with the circuit board. Preventive means prevents unexpected disassembly when the terminal and the terminal plate lose threaded engagement and eliminates the need for after-integration processing. A guiding means, formed integrally with the terminal, guides the terminal into threaded engagement with the terminal plate when the terminal and the terminal plate lose threaded contact. Guiding means also prevents damage to a terminal plate screw hole and speeds assembly.

According to an embodiment of the present invention there is provided, a terminal connector comprising: a circuit board having a top and bottom face, a terminal plate attached to the circuit board, a terminal having a screw portion engaged in a screw hole formed in the terminal plate, the circuit board having a through hole, into which the terminal is inserted from the bottom face, to which the terminal plate is attached as well, and means for preventing the terminal from separating from the terminal plate when the screw portion of the terminal and the screw hole in the terminal plate lose threaded engagement.

According to another embodiment of the present invention there is provided a terminal connector with preventive means further comprising: a preventive lock portion extended inward from. a cylindrical portion, and a preventive lock retention portion extended outward from the terminal.

According to another embodiment of the present invention there is provided a terminal connector further comprising: an insertion slot provided in a bottom surface of said circuit board to accommodate a bent portion of the terminal plate, and a lock tab integral with the bent piece for locking with a lock step provided in the insertion slot, the terminal plate attached to the insulative circuit board by inserting a bent piece of the terminal plate into the insertion slot provided on the bottom surface of the insulative circuit board so that the lock tab is locked into a lock step provided in the insertion slot.

According to another embodiment of the present invention there is provided a terminal comprising: a screw portion, a minor diameter portion having a diameter smaller than that of said screw portion, a collar, a plug connection portion, and a knob having a plug insertion opening, the screw portion and the minor diameter portion being extended toward one end away from the collar at the center, the plug connection portion extended toward the other end away from the collar, the outer periphery of the plug connection portion being covered with the knob, and the minor diameter portion fitting in the screw hole when the screw portion of said terminal and said screw hole in said terminal plate threadably disengage with each other and the terminal is retained by said coming-off preventive means, the means composed of a coming-off preventive lock portion extended inward from a cylindrical portion and a coming-off preventive lock portion extended outward from the terminal.

The above, and other objects, features and advantages of the present invention will become apparent from the following description read in conjunction with the accompanying drawings, where like reference numerals designate the same elements.

DETAILED DESCRIPTION OF THE INVENTION

Figure 1:
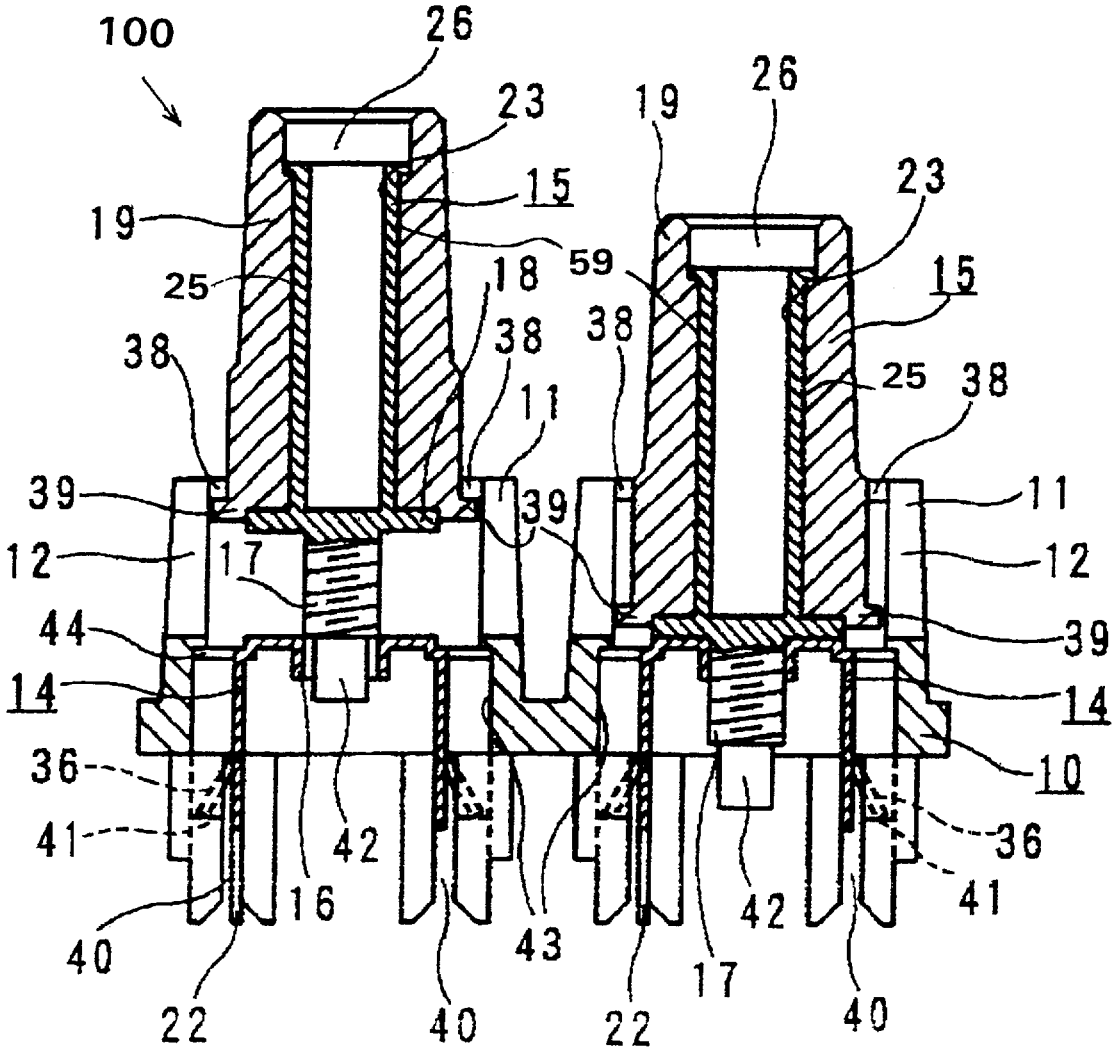
FIG. 1 is a sectional view along line A—A of FIG. 3, showing an embodiment of the terminal connector.

Referring to FIG. 1, a terminal connector, shown generally at 100, includes an electrically conductive terminal plate 14 mounted to an insulative circuit board 10. A terminal 15 is secured to insulative circuit board 10 by a screw portion 17 threaded into a screw hole 16 in terminal plate 14. A knob 19, fixed projecting away from terminal 15 enables screwing and unscrewing of screw portion 17 for making electrical connection, as will be explained.

A cylindrical portion 11, surrounding a part of terminal 15 near a first surface of insulative circuit board 10, helps avoid lead wire shorts and reduces the chance of electrical contact with a person or an; object. Cylindrical portion 11 is formed cylindrically about a center axis and has at least one wire insertion notch 12 in its outer periphery. Cylindrical portion 11 includes lock portion 38 protruding from an upper edge of cylindrical portion 11 and facing the central axis. Lock portions 38, combined with retention portions 39 (later described) constitute a preventive means, as will be explained. In this embodiment. insulative circuit board 10 has four cylindrical portions 11 formed on the first surface.

Each terminal 15 comprises knob 19 surrounding a terminal body 59. Knob 19 protrudes away from the first surface and is generally cylindrical in shape. A fit hole 25 contains plug connection portion 23, and passes through the center of knob 19. A plug insertion opening 26, having a diameter greater than that of fit hole 25, is formed at the top of fit hole 25. A circular recess at the bottom of fit hole 25 engages a collar 18. Knob 19 is made from an electrically insulating material such as resin.

The electrically conductive terminal body 59 is an integrally formed element with plug connection portion 23 at a first end, and a minor diameter portion 42 at a second end. Terminal body 59 is integrally formed from by a cold forging process or the like. Plug connection portion 23 is suitable for accepting the insertion of a conventional banana tip, a wire end, or other conductor. Collar 18 is disposed at a first intermediate location and contacts plug connection portion 23. A screw portion 17 is disposed at a second intermediate location and contacts minor diameter portion 42.

Plug connection portion 23, collar 18, screw portion 17, and minor diameter portion 42 all have circular shapes about a common axis. That is, plug connection portion 23 has a cylindrical shape, collar 18 has a disk-like shape, screw portion 17 has a cylindrical-column shape, and minor diameter portion 42 has a cylindrical-column shape. Screw portion 17 contains a continuous helical thread having a minor diameter measured from a central axis of screw portion 17. Minor diameter portion 42 has a diameter, measured from the same central axis, less than the minor diameter of screw portion 17. Minor diameter portion 42 serves as a guiding means later described.

Knob 19 and terminal body 59 are fixed to each other by both the engagement of collar 18 and the swaging of a top rim of plug connection portion 23 to form a complete terminal 15. This engagement prevents terminal body 59 and knob 19 from rotating respective to each other and from losing contact with each other as terminal 15 adjusts.

Knob 19, on terminal 15, has integral circular retention portions 39, formed around an exterior circumference and projecting away from a central axis. Knob 19 has a diameter, relative to the central axis, smaller than that of lock portions 38 formed on cylindrical portion 11 so as to allow adjustment of terminal 15 within cylindrical portion 11.

The inner diameter of cylindrical portion 11, relative to the central axis of terminal 15, is greater than that of retention portions 39 to allow insertion of terminal 15 from a second surface of circuit board 10. However, the inner diameter of lock portions 38 is less than the outer diameter of retention portions 39 so as to prevent free passage of terminal 15 from the second surface of circuit board 10 through cylindrical portion 11 to the first surface of circuit board 10. Together, lock portions 38 of cylindrical portion 11, and retention portions 39 of knob 19, retain terminal 15.

Formed on the second surface of circuit board 10 are through holes 43. Through holes 43 have a diameter larger than the inner diameter of cylindrical portion 11, but smaller than the outer diameter of cylindrical portion 11, thus integrally forming step 44. Through holes 43 pierce the first surface of insulative circuit board 10 and accommodate terminal plate 14.

Also formed around through hole 43, on the second surface of circuit board 10, is a plurality of integral insertion slots 40 with lock steps 41 for 10 receiving and guiding terminal projections 22 of terminal plate 14. Lock steps 41 are formed about a central axis of through hole 43 perpendicular to terminal portions 22 of terminal plate 14.

Figure 2:
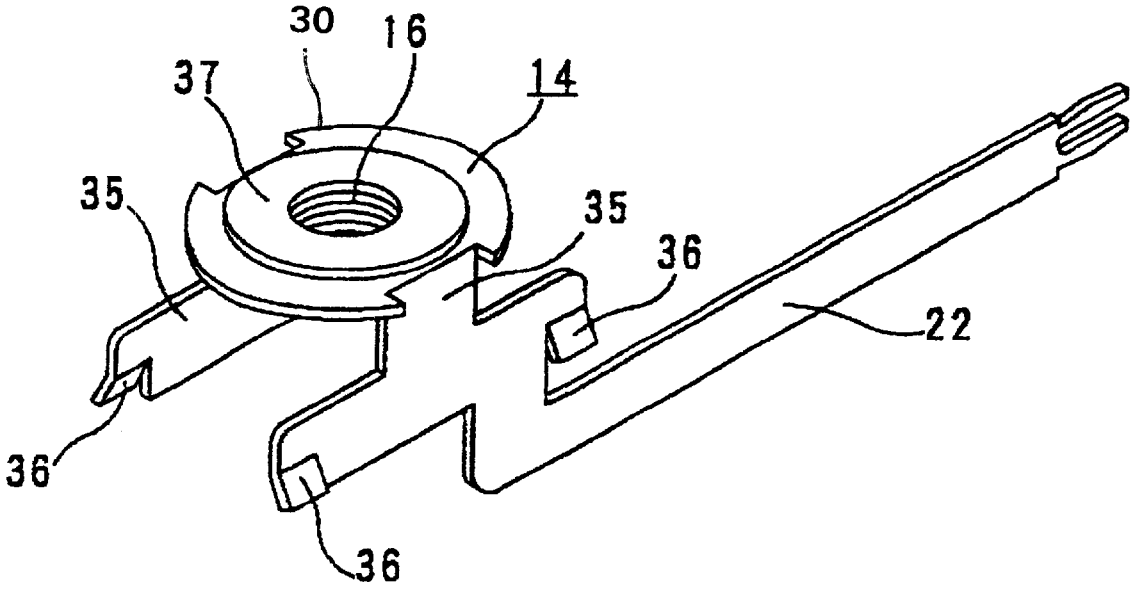
FIG. 2 is a perspective view showing an embodiment of the terminal plate used in the terminal connector according to the present embodiment.

As additionally shown in FIG. 2, each terminal plate 14, consisting of an electrically conductive material, is formed as a disk portion 30 having a central axis and a bulged contact surface portion 37 surrounding a central cylindrical threaded screw hole 16. Screw hole 16 enables threaded electrical contact between terminal 15 with screw portion 17 and terminal plate 14. At opposite sides of terminal plate 14, with disk portion 30, a pair of bent pieces 35 extend away from contact surface portion 37 each having a pair of erect lock tabs 36. At least one of the bent pieces 35 is formed and extended along a terminal portion 22 having a distal end. Terminal portions 22 may be of variable lengths depending upon manufacturing demands.

Figure 3:
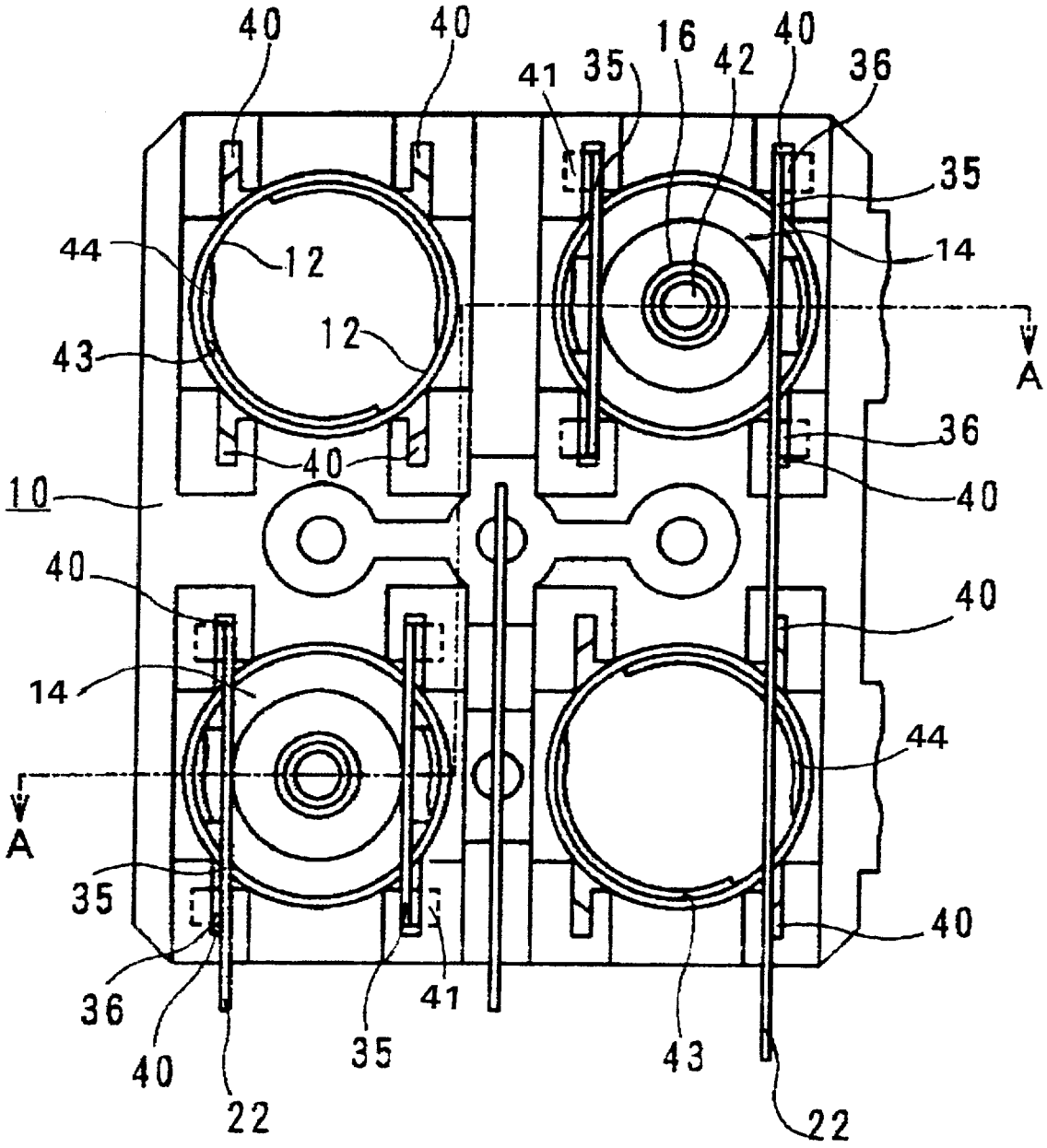
FIG. 3 is a bottom view showing an embodiment of a terminal connector where the upper right and lower left through holes each contain a terminal plate and terminal while the upper left and lower right through holes are empty.
Figure 4:
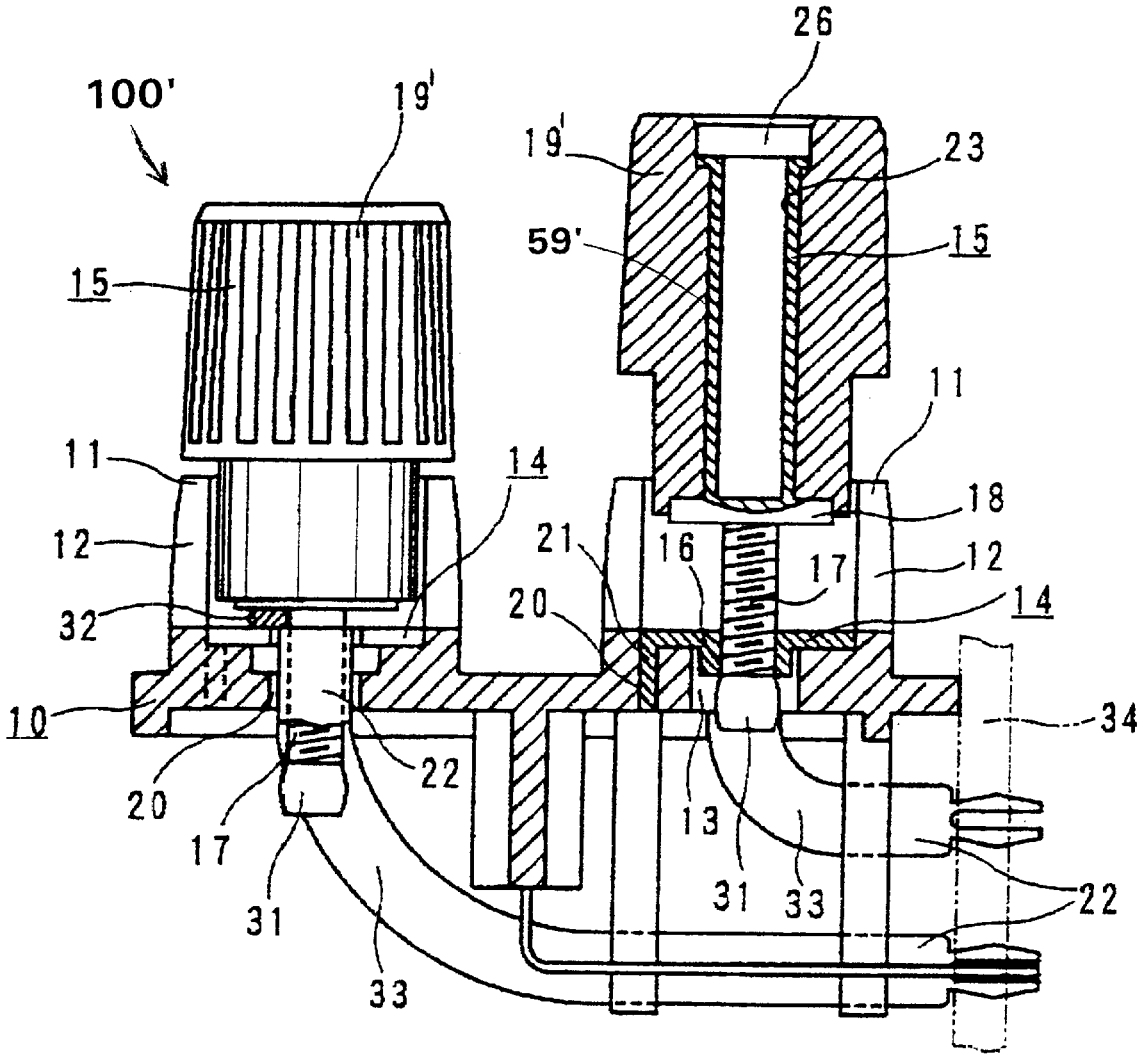
Fig. 4 PRIOR ART
FIG. 4 is a sectional view along line B—B of FIG. 5, showing a conventional terminal connector.
Figure 5:
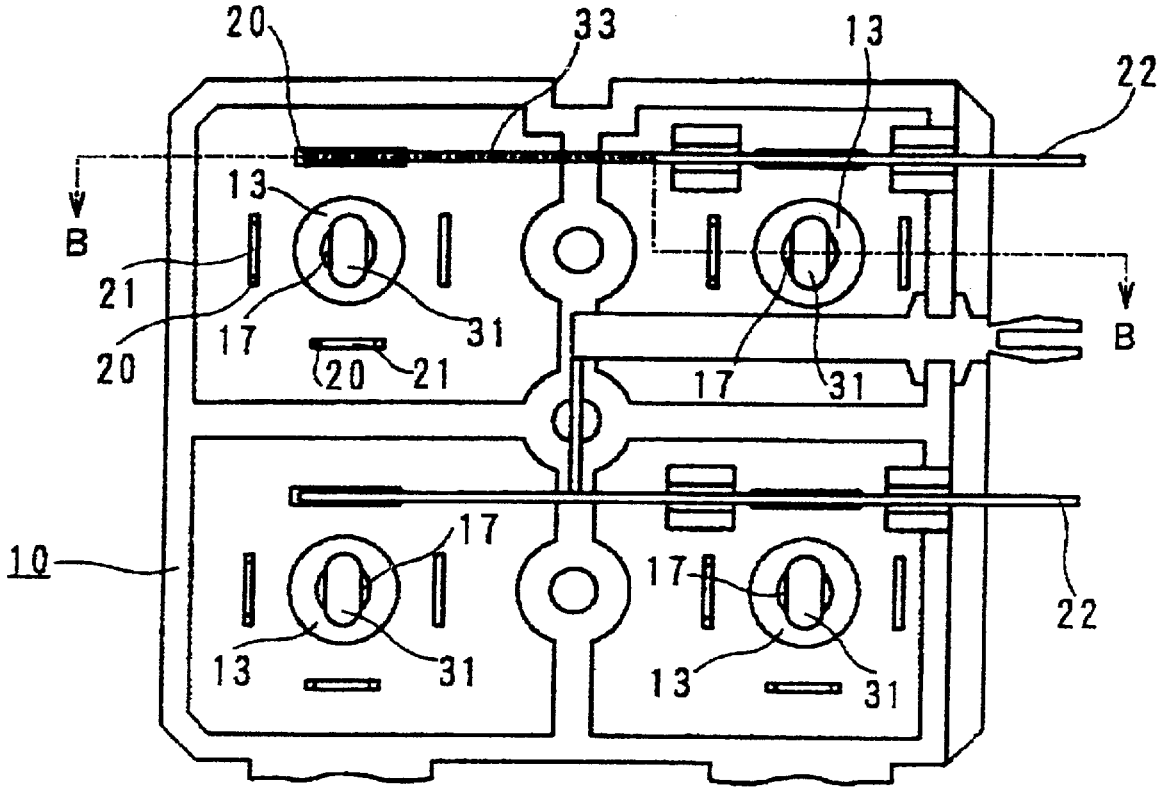
Fig. 5 PRIOR ART
FIG. 5 is a bottom view showing the conventional terminal connector of FIG. 4.
Figure 6:
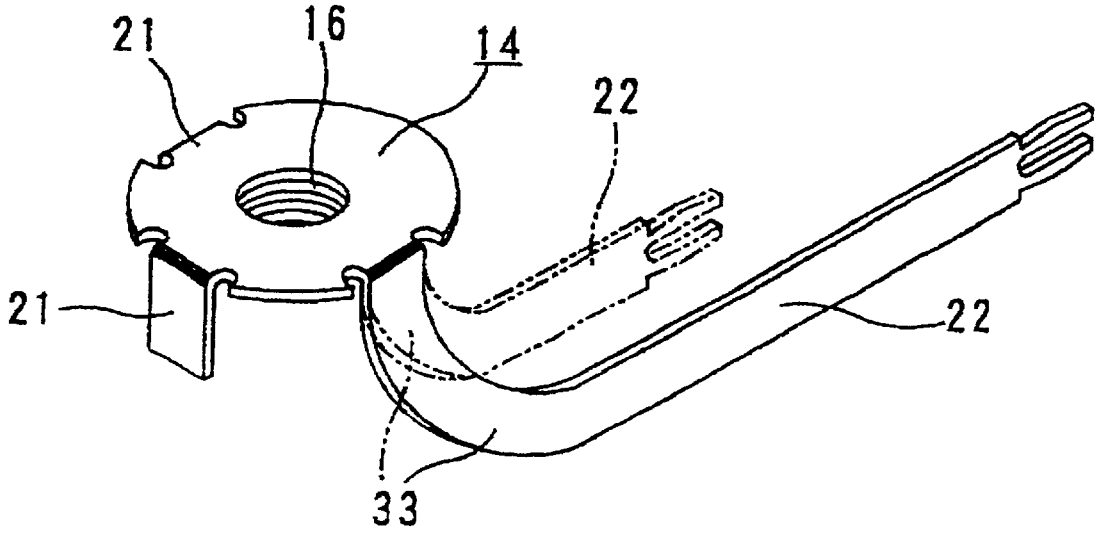
Fig. 6 PRIOR ART
FIG. 6 is a perspective view of a conventional terminal plate

Additionally referring to FIG. 3, insulative circuit board 10 has four through holes 43 each having steps 44 and insertion slots 40 with lock steps 41. Here, relative to the plane of the page, the top right and bottom left through holes 43 contain terminal plates 14 with terminals 15. Bent pieces 35 of terminal plate 14 are retained between insertion slots 40 with lock steps 41 by lock tabs 36 projecting into lock steps 41. As a result, disk portions 30 of terminals 14 firmly abut steps 44 in through holes 43. Thus, terminal plates 14 are affixed to circuit board 10 and resists separation. In this embodiment, relative to the plane of the page, the top right and bottom right through holes 43 do not contain terminal plates 14 nor terminals 15.

During assembly of terminal connector 100, circuit board 10 is inverted so that the second side faces upward towards an operator and terminals 15, with knobs 19 and terminal bodies 59, are inverted and inserted into through holes 43. During insertion of terminals 15 into through holes 43, knobs 19 with annular retention portions 39, project into cylindrical portions 11 and contact annular lock portions 38.

Next during assembly, terminal plate 14, with bent pieces 35, is inverted and aligned with insertion slots 40, formed on circuit board 10. During alignment, a central axis of screw hole 16 on terminal 14 and a central axis of minor diameter portion 42 of terminal 15 are aligned. Since minor diameter portion 42 has a diameter smaller than that of screw hole 16, minor diameter portion 42 functions to align and guide terminal plate 14 during assembly. Terminal plate 14 with disk portion 30 is inserted through insertion slots 40 and pressed downward into through hole 43 towards the first surface of circuit board 10. Pressing continues until disk portion 30 contacts step 44 and lock tabs 36 are released from elastic compression and extended into lock steps 41, thereby fixing terminal plates 14 into circuit board 10.

Simultaneously, screw hole 16 of terminal plate 14 surrounds minor diameter portion 42 of terminal 15, thereby retaining terminal 15 between contact surface portion 37 of terminal plate 14 and lock portion 38 of cylindrical portions 11 thus enabling both guiding means for screw portion 17 and preventive means for terminal 15.

After insertion of terminal plates 14, circuit board 10 is inverted so that the first face is facing upward and that terminals 15, with minor diameter portions 42, are guided by into aligned contact with screw hole 16. Knobs 19 are rotated so that threaded portions 17 of terminals 15 engage screw holes 16 of terminal plates 14, and thereby complete assembly of terminal connector 100.

Depending upon manufacturing requirements, extended terminal portions 22 of terminal plate 14 may engage more than one adjacent insertion slot 40 around adjacent through holes 43 so as to securely protrude a distal end to an edge of circuit board 10.

After assembly of terminal connector 100, banana clips, wire leads or other contacts may be inserted in plug insertion opening 26 of terminal 15 or through insertion notches 12 of cylindrical portion 11, to enable electrical contact to terminal projections 22 of terminal plate 14.

The present embodiment offers several positive points.

First, even where knobs 19 are reversed until screw portions 17 and screw holes 16 threadably disengage, minor diameter portions 42 simply provide free rotation while lock portions 38 and retention portions 39 contact each other and prevent terminal 15 from being removed from cylindrical portion 11.

Second, while minor diameter portions 42 may turn freely in screw holes 16, minor diameter portions 42 also maintains insertion in screw holes 16. Therefore, when knobs 19 are tightened again, minor diameter portions 42 guided threaded portions of terminals 15 into screw holes 16 for quick and smooth threaded engagement.

Third, in the present embodiment, terminals 15 are inserted from the second surface of circuit board 10 into through holes 43 and terminal plates 14 are attached thereto. This eliminates the need for the conventional manufacturing step of flattening the extremities of screw portions 17 of terminals 15 to form preventive bulged portions 31. This saves manufacturing time and manufacturing resources.

Fourth, since terminals 15 and terminal plates 14 are simply inserted in insulative circuit board 10, automated assembly is more easily achieved saving manufacturing costs.

Fifth, preventive means consisting of lock portions 38 integral with cylindrical portions 11 and retention portions 39 protruded from terminals 15, facilitate the fabrication of insulative circuit board 10 by preventing unplanned disassembly and lost parts.

Sixth, integral bent pieces 35 and lock tabs 36 of terminal plate 14 are inserted in insertion slots 40. Accordingly, the integration of terminal plates 14 to insulative circuit board

10 requires the pressing of terminal plate 14 into insertion slots 40 on insulative circuit board 10 to thereby engage lock tabs 36 into lock steps 41. As a result, assembly is easily automated.

Seventh, after assembly, minor diameter portion 42, within screw hole 16 guides screw portion 17 of terminal 15 into threaded engagement with screw hole 16. This prevents misalignment of threaded portion 17 with screw hole 16 eliminating thread damage and enabling simplified loosening and tightening of terminal 15 to terminal plate 14. As a result, manufacturing costs and time are reduced and later operators of terminal connectors 100 work faster.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A terminal connector comprising:

an circuit board;

said circuit board having a first and a second face;

a through hole formed between said second face and said first face;

an edge of said through hole integrally forming a step in said circuit board parallel to said second face;

a terminal plate insertable into said through hole from said second face of said circuit board;

at least said step and at least one insertion slot aligning said terminal plate with said circuit board during an insertion of said terminal plate from said second face;

said terminal plate fixed to said second face;

a terminal having a threaded screw portion threadably engageable in a screw hole in said terminal plate; and means for preventing said terminal from separating from said circuit board when said screw portion of said terminal and said screw hole in said terminal plate a not in threaded engagement.

2. A terminal connector according to claim 1, wherein said means comprises:

a first preventive lock portion extended radially inward from a cylindrical portion formed on said first face of said circuit board;

a second preventive lock portion extended. outward from a bottom rim of said terminal; and said first preventive lock portion contacting said second preventive lock portion when said terminal is not in threaded engagement with said terminal plate thereby preventing said terminal from passing away from said first surface.

3. The terminal connector according to claim 1, further comprising:

said at least one insertion slot in said second face of said circuit board extending away from said first face;

said insertion slot positioning a bent portion of said terminal plate during said insertion; and at least one lock tab integral with said bent piece lockable in a lock step formed in said insertion slot during said insertion thereby securely retaining said bent piece, said terminal, and said terminal plate in said circuit board.

4. The terminal connector according to claim 1, wherein said terminal further comprises:

a terminal body;

said terminal body including a collar extending radially therefrom;

a generally cylindrical portion of said terminal body extending on a first side of said collar;

said threaded portion of said terminal extending on a second side of said collar;

a minor diameter portion having a diameter smaller than that of said threaded portion also extending on a second side of said collar distal from said collar;

a knob press fitted onto said cylindrical portion; and said minor diameter portion fitting in said screw hole when said screw portion of said terminal and said screw hole in said terminal are not in threaded engagement with each other and said terminal is retained by said means for preventing.

* * * * *